US010172445B2

(12) United States Patent
Wainless

(10) Patent No.: US 10,172,445 B2
(45) Date of Patent: Jan. 8, 2019

(54) PACKAGED ORAL CARE IMPLEMENT AND ORAL CARE IMPLEMENT THEREOF

(71) Applicant: COLGATE-PALMOLIVE COMPANY, New York, NY (US)

(72) Inventor: Daniel Wainless, New Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/345,176

(22) Filed: Nov. 7, 2016

(65) Prior Publication Data

US 2018/0125225 A1 May 10, 2018

(51) Int. Cl.

| | |
|---|---|
| ***A46B 15/00*** | (2006.01) |
| ***A46B 9/04*** | (2006.01) |
| ***A46B 5/02*** | (2006.01) |
| ***B65D 75/00*** | (2006.01) |
| *B65D 75/36* | (2006.01) |

(52) U.S. Cl.

CPC ..... *A46B 15/0097* (2013.01); *A46B 5/026* (2013.01); *A46B 9/04* (2013.01); *B65D 75/00* (2013.01); *A46B 2200/1066* (2013.01); *B65D 75/366* (2013.01)

(58) Field of Classification Search

CPC ..... A46B 15/0097; A46B 5/026; A46B 5/02; A46B 9/04; A46B 2200/1066

See application file for complete search history.

(56) References Cited

U.S. PATENT DOCUMENTS

| | | | |
|---|---|---|---|
| 1,899,242 | A | 2/1933 | McNab |
| 5,522,109 | A | 6/1996 | Chan |
| 5,742,971 | A | 4/1998 | Salinger |
| 5,881,421 | A | 3/1999 | Ducharme |
| 6,076,223 | A | 6/2000 | Dair et al. |
| D456,136 | S | 4/2002 | Roehrig |
| D462,178 | S | 9/2002 | Moskovich et al. |
| 6,564,940 | B2 | 5/2003 | Blaustein et al. |
| D505,264 | S | 5/2005 | Chen |
| D510,482 | S | 10/2005 | Jimenez |
| D510,808 | S | 10/2005 | Bantleon et al. |
| 7,047,591 | B2 | 5/2006 | Hohlbein |

(Continued)

FOREIGN PATENT DOCUMENTS

| | | |
|---|---|---|
| CN | 303555837 | 1/2016 |
| EP | 1480578 | 5/2011 |

(Continued)

*Primary Examiner* — Laura C Guidotti

(57) ABSTRACT

An oral care implement including a handle extending along a longitudinal axis, a head coupled to one end of the handle, and a flexible support element coupled to the other end of the handle. In one embodiment, a reference plane that is non-parallel to the longitudinal axis of the handle contacts an outer surface of the handle without intersecting the flexible support element and without penetrating the outer surface of the handle. The oral care implement may be positioned within a product retaining cavity of a package with a portion of the oral care implement in contact with a support member of the package. In such embodiment, the oral care implement may be positioned such that the flexible support element is raised within the package so that it does not contact the support member.

11 Claims, 4 Drawing Sheets

(56) References Cited

U.S. PATENT DOCUMENTS

| | | | | |
|---|---|---|---|---|
| 7,059,471 | B2 | 6/2006 | Fattori | |
| D532,202 | S | 11/2006 | Hohlbein | |
| D566,400 | S | 4/2008 | Phillips | |
| D587,905 | S | 3/2009 | Wong | |
| 8,079,109 | B2 | 12/2011 | Misner et al. | |
| 8,245,844 | B2 | 8/2012 | Sorrentino et al. | |
| 8,973,202 | B2 | 3/2015 | Fischer et al. | |
| 9,107,491 | B2 | 8/2015 | Brown et al. | |
| 9,357,837 | B2 | 6/2016 | Henderson | |
| 9,409,689 | B2 | 8/2016 | Nguyen | |
| D776,436 | S * | 1/2017 | Xi | D4/104 |
| 2002/0100134 | A1 | 8/2002 | Dunn et al. | |
| 2006/0207043 | A1* | 9/2006 | Yamamoto | A46B 5/00 15/143.1 |
| 2011/0016651 | A1 | 1/2011 | Piserchio | |
| 2011/0024944 | A1 | 2/2011 | Pfenniger et al. | |
| 2011/0041272 | A1 | 2/2011 | Prencipe et al. | |
| 2014/0158152 | A1 | 6/2014 | Butz et al. | |
| 2015/0013088 | A1* | 1/2015 | Li | F21V 33/004 15/167.1 |

FOREIGN PATENT DOCUMENTS

| | | |
|---|---|---|
| EP | 3117739 | 1/2017 |
| WO | 1998/012947 | 4/1998 |
| WO | D079739 | 11/2012 |
| WO | D086213 | 3/2015 |

* cited by examiner

PACKAGED ORAL CARE IMPLEMENT AND ORAL CARE IMPLEMENT THEREOF

BACKGROUND

Oral care implements such as toothbrushes are used daily to clean the interior surfaces of a user's mouth including the gums and the teeth. Because toothbrushes, and particularly the head portions thereof that have tooth cleaning elements extending therefrom, are inserted into a user's mouth during use, it is important to maintain them in a sanitary condition to avoid introducing bacteria into the user's mouth which can cause sickness. When an oral care implement is laid to rest against a countertop, there is the possibility that the tooth cleaning elements will contact germs or bacteria. Thus, it is desirable to maintain oral care implements in an upright/vertical position. One technique for achieving upright storage of an oral care implement is the use of a suction cup. However, there is difficulty in packaging an oral care implement with a suction cup without deforming the suction cup, which will render it ineffective at maintaining the oral care implement in the desired upright orientation. Thus, a need exists for a packaged oral care implement and an oral care implement thereof that overcomes the above-noted deficiencies.

BRIEF SUMMARY

The present invention may be directed, in one aspect, to an oral care implement including a handle extending along a longitudinal axis, a head coupled to the proximal end of the handle, and a flexible support element coupled to the distal end of the handle. In one embodiment, a reference plane that is non-parallel to the longitudinal axis of the handle contacts the handle at a first point and a second point without intersecting the flexible support element. The first and second points may be separated from one another by a region of the handle that is not intersected or contacted by the reference plane. In one embodiment, the oral care implement may be positioned within a product retaining cavity of a package with a portion of the oral care implement in contact with a support member of the package. In such embodiment, the oral care implement may be positioned such that the flexible support element is raised within the package so that it does not contact the support member.

In one aspect, the invention may be an oral care implement comprising: a handle extending along a longitudinal axis from a distal end to a proximal end and having a front surface and an opposite rear surface; a head coupled to the proximal end of the handle; a flexible support element coupled to the distal end of the handle; and wherein a reference plane that is non-parallel to the longitudinal axis of the handle is tangent to the handle at a first point and a second point without intersecting the flexible support element.

In another aspect, the invention may be an oral care implement comprising: a handle extending along a longitudinal axis from a distal end to a proximal end and having an outer surface; a head coupled to the proximal end of the handle; a flexible support element coupled to the distal end of the handle; and wherein a reference plane that is non-parallel to the longitudinal axis of the handle contacts the outer surface of the handle at a first point and a second point without intersecting the flexible support element; and wherein a region of the outer surface of the handle located axially between the first and second points faces the reference plane without contacting the reference plane.

In yet another aspect, the invention may be an oral care implement comprising: a handle extending along a longitudinal axis from a distal end to a proximal end and having an outer surface; a head coupled to the proximal end of the handle; a flexible support element coupled to the distal end of the handle; wherein a reference plane that is non-parallel to the longitudinal axis of the handle contacts the outer surface of the handle without penetrating the outer surface of the handle and without intersecting the flexible support element.

In still another aspect, the invention may be an oral care implement comprising: a handle extending along a longitudinal axis; a head coupled to a first end of the handle; a flexible support element coupled to a second end of the handle; and wherein a reference plane that is non-parallel to the longitudinal axis of the handle contacts an outermost surface of the handle at multiple discrete locations without intersecting the flexible support element or the head.

In a further aspect, the invention may be a packaged oral care implement comprising: a package comprising a support member and a product retaining cavity, the support member having a front surface; an oral care implement comprising a handle extending along a longitudinal axis from a distal end to a proximal end, a head coupled to the proximal end of the handle, and a flexible support element coupled to the distal end of the handle; wherein the oral care implement is positioned within the product retaining cavity with a portion of the handle in contact with the front surface of the support member; and wherein the flexible support element is spaced apart from the front surface of the support member.

In a still further aspect, the invention can be an oral care implement comprising: a handle extending along a longitudinal axis from a distal end to a proximal end and having an outer surface; a flexible support element coupled to the distal end of the handle and being symmetric about the longitudinal axis of the handle; wherein a reference plane contacts the outer surface of the handle without penetrating the outer surface of the handle and without intersecting the flexible support element.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
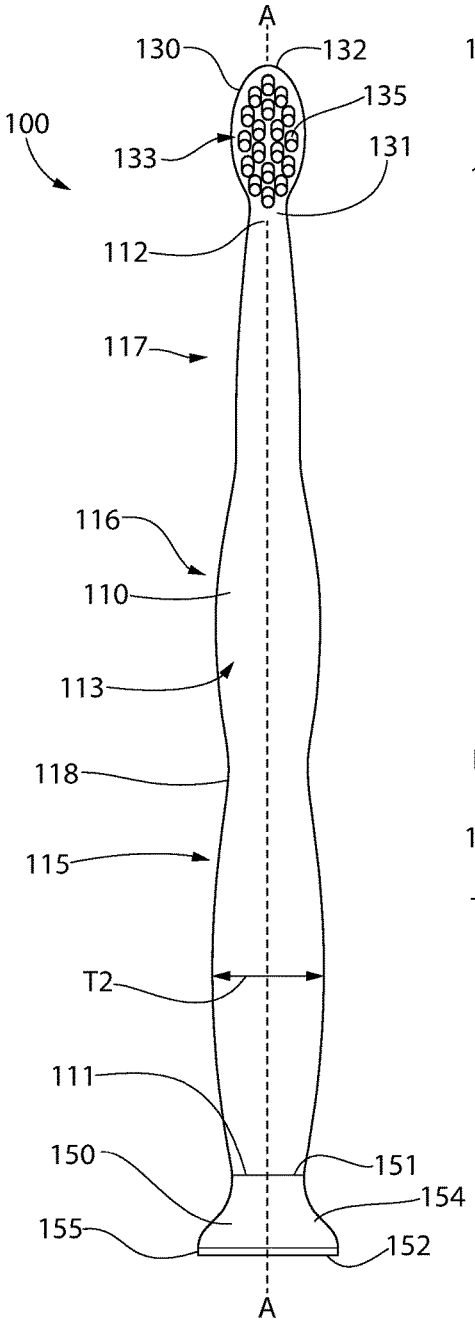
FIG. 1 is front view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
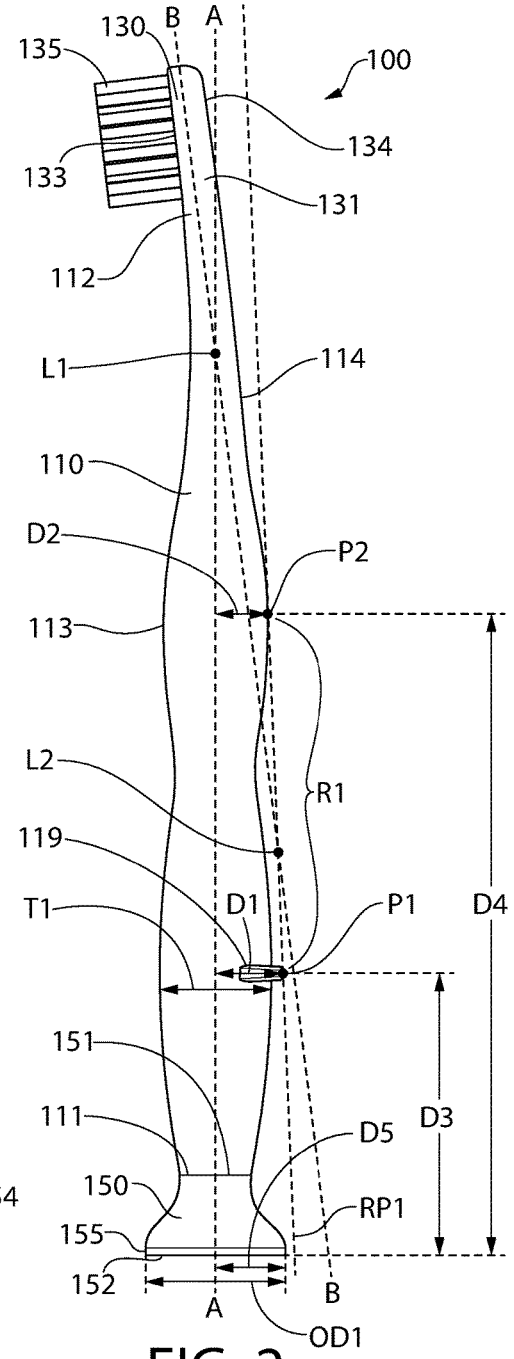
FIG. 2 is a side view of the oral care implement of FIG. 1.
Figure 3:
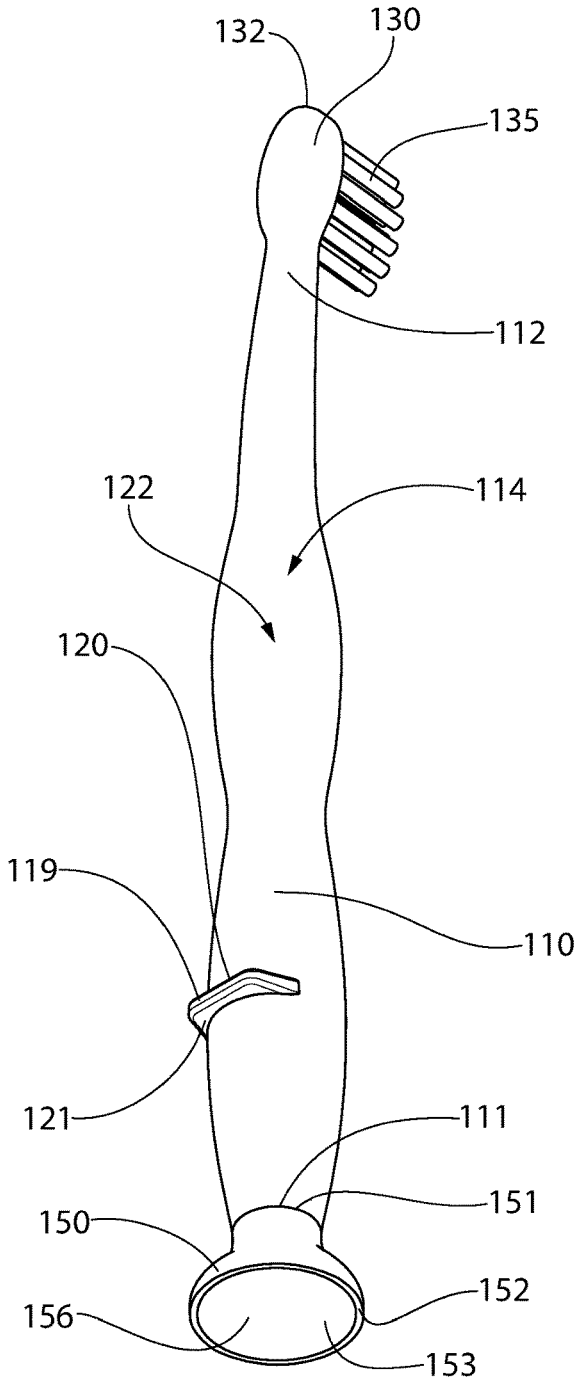
FIG. 3 is a rear perspective view of the oral care implement of FIG. 1.

Referring to FIGS. 1-3 concurrently, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having cleaning elements, or any other type of implement that is commonly used for oral care. In some embodiments the oral care implement 100 may be any type of personal care implement, and not one that is specifically used for oral care, such as a deodorant application implement, a face or body cleaning implement, a razor, a hairbrush, or the like. Thus, the invention is not to be limited by the particular type of implement unless so specified in the claims.

The oral care implement 100 generally comprises a handle 110, a head 130, and a flexible support element 150. The handle 110 extends from a distal end 111 to a proximal end 112 and has a front surface 113 and an opposite rear surface 114. The head 130 extends from a proximal end 131 to a distal end 132. The flexible support element 150 extends from a proximal end 151 to a distal end 152. The head 130 is coupled to the proximal end 112 of the handle 110. The flexible support element 150 is coupled to the distal end 111 of the handle 110.

In the exemplified embodiment the handle 110 and the head 130 form an integral structure in that they are formed as a single, unitary component. The handle 110 is an elongated structure that provides the mechanism by which the user can hold and manipulate the oral care implement 100 during use. In the exemplified embodiment, the handle 110 extends from the proximal end 111 to the distal end 112 along a longitudinal axis A-A. Furthermore, in the exemplified embodiment the handle 110 has an undulating shape that comprises a proximal section 115, a distal section 116, and a neck section 117. The proximal and distal sections 115, 116 are bulbous shaped sections of the handle 110 that meet at a waist portion 118 of the handle 110. Specifically, the proximal and distal sections 115, 116 are bulbous when viewed both from the front/rear of the oral care implement 100 (FIG. 1) and when viewed in side profile (FIG. 2).

The waist portion 118 of the handle 110 has a reduced transverse cross-sectional area relative to the proximal and distal sections 115, 116. The neck section 117 extends from the distal section 116 to the distal end 112 of the handle 110. In the exemplified embodiment, the neck section 117 tapers/decreases in cross-sectional area as it extends from the distal section 116 to the distal end 112 of the handle 110. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

The handle 110 may be formed of a hard or rigid plastic material, such as for example without limitation polymers and copolymers of ethylene, propylene, butadiene, vinyl compounds, and polyesters such as polyethylene terephthalate. The handle 110 may also include a grip that is formed of a resilient/elastomeric material, such as a thermoplastic elastomer. Such a grip may be molded over a portion of the handle 110 that is typically gripped by a user's thumb and forefinger during use. Furthermore, it should be appreciated that additional regions of the handle 110 can be overmolded with the resilient/elastomeric material to enhance the gripability of the handle 110 during use. For example, portions of the handle 110 that are typically gripped by a user's palm during use may be overmolded with a thermoplastic elastomer or other resilient material to further increase comfort to a user. Furthermore, materials other than those noted above can be used to form the handle 110, including metal, wood, or any other desired material that has sufficient structural rigidity to permit a user to grip the handle 110 and manipulate the oral care implement 100 during oral care activities such as toothbrushing or personal care activities such as facial cleansing.

The head 130 of the oral care implement 100 is coupled to the handle 110 and comprises a front surface 133 and an opposing rear surface 134. As noted above, the head 130 may be formed integrally with the handle 110 as a single unitary structure using a molding (i.e., injection molding), milling, machining, or other suitable process. Thus, the head 130 may, in certain embodiments, be formed of any of the rigid plastic materials described above as being used for forming the handle 110, although the invention is not to be so limited in all embodiments and other materials that are commonly used during toothbrush head manufacture may also be used. In other embodiments the handle 110 and the head 130 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Furthermore, the head 130 may be a separate component from the handle 110 that is readily attachable thereto and detachable therefrom as desired. In this manner, the head 130 may be a refill head such that the head 130 can be replaced without replacing the entire oral care implement 100.

In the exemplified embodiment, a plurality of tooth cleaning elements 135 are coupled to and extend from the head 130 of the oral care implement 100. More specifically, in the exemplified embodiment the tooth cleaning elements 135 extend from the front surface 133 of the head 130. A tongue or soft tissue cleaner (not depicted) may be positioned on the rear surface 134 of the head 130. Such a tongue or soft tissue cleaner may be formed of an elastomeric material and may include protrusions, nubs, ridges, scrapers, or the like for engaging and cleaning a user's oral tissue surfaces.

The term "tooth cleaning elements" is used herein in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. The tooth cleaning elements may include tapered bristles, non-tapered (i.e., end rounded) bristles, and combinations thereof. Any combination of the various types of tooth cleaning elements may be used on the oral care implement 100 in different embodiments. Thus, although the exemplified embodiment illustrates all of the tooth cleaning elements 135 as bristle filaments, the invention is not to be so limited in all embodiments and bristle filaments alone, a combination of bristle filaments and rubber bristles, rubber bristles alone, or other combinations of the different tooth cleaning element types identified above may be used.

In embodiments that use elastomeric/rubber elements as one or more of the tooth cleaning elements 135, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used. The tooth cleaning elements 135 may be coupled to the head 130 using any techniques known in the art, including without limitation staples, anchor-free tufting, in-mold tufting, AMR, or the like. The invention is not to be limited by the manner in which the tooth cleaning elements 135 are coupled to the head 130 in all embodiments.

As noted above, the flexible support element 150 is coupled to and extends from the proximal end 111 of the handle 110. The flexible support element 150 does not overlap with any portion of the length of the handle 110, but rather it extends from the proximal end 111 of the handle 110 only in a direction away from the proximal end 111 of the handle. The flexible support element 150 is a natural extension of the handle 110 in that the longitudinal axis A-A of the handle 110 is also the longitudinal axis of the flexible support element 150. Thus, the longitudinal axis A-A of the handle 110 extends through a center of the flexible support element 150. In the exemplified embodiment, the handle 110 and the flexible support element 150 have a balanced appearance in that they are both symmetric about the longitudinal axis A-A.

The distal end 152 of the flexible support element 150 forms the distal-most end of the oral care implement 100. The flexible support element 150 has an inner surface 153 and an outer surface 154. The inner surface 153 defines an interior cavity 156 which is necessary for proper functionality and suctioning of the flexible support element 150. Furthermore, the distal end 152 of the flexible support element 150 has an outer periphery 155 at the outer surface 154. In the exemplified embodiment the distal end 152 of the flexible support element 150 has a round or ring-like shape. Thus, the flexible support element 150 has a circular transverse cross-sectional shape.

In the exemplified embodiment, the flexible support element 150 is a suction cup that can be used to temporarily secure/fix the oral care implement 100 to a support surface. The flexible support element 150 may be formed of an elastomeric material, such as a thermoplastic elastomer, that permits the flexible support element 150 to compress upon being pressed against a surface and to decompress back to its original shape upon no longer being pressed against the surface. Specifically, during use a person can press the flexible support element 150 onto a preferably nonporous surface and the inner surface 153 of the flexible support element 150 will move towards the surface, thereby removing the air between the flexible support element 150 and the surface. When pressure against the flexible support element 150 is removed, the flexible support element 150 will bias back into its original shape without permitting air to enter back into the space between the flexible support element 150 and the surface. This creates a vacuum that enables the flexible support element 150 to remain stuck to the surface. Specifically, the pressure difference between the atmosphere on the outside of the flexible support element 150 and the low-pressure cavity within the flexible support element 150 keeps the flexible support element 150 adhered to the surface. The flexible support element 150 can be suctioned to a surface to maintain the oral care implement 100 in an orientation with the longitudinal axis A-A of the handle 110 perpendicular to the surface.

As noted above, the handle 110 of the oral care implement 100 extends along a longitudinal axis A-A. Furthermore, the head 130 extends along a longitudinal axis B-B. The longitudinal axis of the head B-B is oblique to the longitudinal axis A-A of the handle 110. Thus, the head 130 is oriented at an angle relative to the handle 110. Specifically, the handle 130 is oriented so as to diverge from the longitudinal axis A-A of the handle 110 with increasing distance from the distal end 112 of the handle 110.

In the exemplified embodiment, the handle 110 comprises a protuberance 119 extending from the rear surface 114 thereof. The protuberance 119 has an outer surface 121 and terminates in a distal end 120. The rear surface 114 of the handle 110 and the outer surface 121 of the protuberance 119 collectively form an outer surface 122 of the handle 110. In the exemplified embodiment, the distal end 120 of the protuberance is a flat surface. However, the invention is not to be so limited and the distal end 120 of the protuberance 119 may be curved in other embodiments. In the exemplified embodiment, the protuberance 119 is elongated along the rear surface 114 of the handle 110 in a direction transverse to the longitudinal axis A-A of the handle 110. However, the invention is not to be so limited and the protuberance 119 may be elongated in a direction parallel to the longitudinal axis A-A, or it may be a simple nub-like protrusion or multiple nub-like protrusions that are not elongated. The protuberance 119 may be formed integrally with the rigid plastic material of the handle 110, or it may be formed as a part of an elastomeric overmold that is molded onto the rigid plastic material of the handle 110. The protuberance 119 assists in ensuring that the flexible support element 150 does not become deformed when the oral care implement 100 is placed within a package or otherwise made to rest atop a flat surface in a horizontal orientation. When the oral care implement 100 is positioned on a horizontal surface with the rear surface 114 of the handle 110 facing the horizontal surface, the protuberance 119 acts as a resting surface and is in direct surface contact with the horizontal surface.

In FIG. 2, a reference plane RP1 is illustrated that is non-parallel to the longitudinal axis A-A of the handle 110. The reference plane RP1 is positioned adjacent to the rear surface 114 of the handle 110 and it contacts the outer surface 122 of the handle 110 (which, as discussed above, is formed by the rear surface 114 of the handle 110 and the outer surface 121 of the protuberance 119) at multiple locations. In the exemplified embodiment the reference plane RP1 contacts the outer surface 122 of the handle 110 at two locations, although contact with the outer surface 122 of the handle 110 at more than two locations is also possible within the scope of the present invention. Contact with the outer surface 122 of the handle 110 at any given location is continuous and unbroken contact. Thus, if the reference plane RP1 contacts the outer surface 122 of the handle 110, then breaks contact with the outer surface 122 of the handle 110, and then contacts the outer surface 122 of the handle 110 again at another location, this would constitute two separate and discrete contact locations.

In the exemplified embodiment, a region R1 of the outer surface 122 of the handle 110 located axially between the first and second points P1, P2 is devoid of contact with the reference plane RP1. Specifically, the region R1 of the outer surface 122 of the handle 110 faces the reference plane RP1 without contacting it. Thus, for example, if the first and second points P1, P2 are on the rear surface 114 of the handle 110 (or a protuberance extending therefrom), the region R1 would be a region of the rear surface 114 of the handle 110 that is between the first and second points P1, P2 that does not contact the reference plane RP1. In the exemplified embodiment the reference plane RP1 contacts the outer surface 122 of the handle 110 without penetrating or passing through any portion of the handle 110. Thus, in the exemplified embodiment the reference plane RP1 does not extend into the thickness of the handle 110, or any part of the oral care implement 100, at any location. Rather, the reference plane RP1 merely comes into surface contact with the outer surface 122 of the handle 110 at one or more locations without extending into the handle 110.

Stated another way, the reference plane RP1 is tangent to the handle 110 at a first point P1 on the handle 110 and a second point P2 on the handle 110. As used herein, the term "tangent" is not limited solely to a straight line or plane that touches a curve or curved surface at a point without crossing it at that point. Specifically, the term "tangent" also includes a line or plane that touches a flat or non-curved surface having a minimal length. For example, in the exemplified embodiment the distal end 120 of the protuberance 119 has a length measured in a direction of the longitudinal axis of between 0.5 mm and 1.5 mm. The reference plane RP1 contacts and extends along the distal end 120 of the protuberance 119 and is considered, as the term is used herein, to be tangent to the handle 110 at that contact location. The term tangent may describe continuous contact between the reference plane RP1 and the outer surface 122 of the handle 110 for up to about 3 cm in some embodiments. Thus, the terms first point P1 and second point P2 could each refer to a single discrete point, or a single discrete location/region along the handle 110 that is contacted by the reference plane RP1 in a continuous manner for a short distance relative to the overall length of the oral care implement 100. Whether the first and second points P1, P2 are single discrete points or regions, they are spaced apart by a region that is not contacted by the reference plane RP1.

In the exemplified embodiment, the reference plane RP1 is located adjacent to the rear surface 114 of the handle 110. However, the invention is not to be so limited in all embodiments and the reference plane RP1 could be adjacent to one of the lateral side surfaces of the handle 110 (between the front and rear surfaces 113, 114 of the handle 110) in other embodiments. In the exemplified embodiment, the first point P1 is located on the protuberance 119 and the second point P2 is located on the rear surface 114 of the handle 110. Stated another way, the protuberance 119, and specifically the distal end 120 thereof, comprises the first point P1 and the second point P2 is located directly on the rear surface 114 of the handle 110. However, the invention is not to be so limited and the protuberance 119 may be omitted in some embodiments and the shape of the handle 110 modified to ensure that the reference plane RP1 is tangent to (or continuously contacts) the handle 110 at two locations. As shown, the reference plane RP1 is tangent to the handle 110 at the first and second points P1, P2 without intersecting any portion of the flexible support element 150 and without intersecting any portion of the head 130. Furthermore, in the exemplified embodiment the reference plane RP1 is tangent to the handle 110 at only the first and second points/locations P1, P2 and not at any other point/location, although as described above the invention is not limited to this embodiment only.

In the exemplified embodiment, the first point P1 is located a first distance D1 from the longitudinal axis A-A of the handle 110 measured in a direction transverse to the longitudinal axis A-A of the handle 110. Furthermore, the first point P1 is located a third distance D3 from the distal end 152 of the flexible support element 150 measured in a direction parallel to the longitudinal axis A-A of the handle 110. The second point P2 is located a second distance D2 from the longitudinal axis A-A of the handle 110 measured in a direction transverse to the longitudinal axis A-A of the handle 110. Furthermore, the second point P2 is located a fourth distance D4 from the distal end 152 of the flexible support element 150 measured in a direction parallel to the longitudinal axis A-A of the handle 110.

The outer periphery 155 of the distal end 152 of the flexible support element 150 forms a maximum outer diameter OD1 of the flexible support element 150. The outer periphery 155 of the distal end 152 of the flexible support element 150 is spaced a fifth distance D5 from the longitudinal axis A-A of the handle 110 measured in a direction transverse to the longitudinal axis A-A of the handle 110. In the exemplified embodiment, the longitudinal axis A-A of the handle 110 passes exactly through the center of the flexible support element 150, and thus the fifth distance D5 is equal to the radius of the distal end 152 of the flexible support element 150 (or one-half of the maximum outer diameter OD1 of the flexible support element 150).

The handle 100 of the oral care implement 100 has a first maximum thickness T1 measured between the front and rear surfaces 113, 114 of the handle 110 and a second maximum thickness T2 measured between opposing side surfaces of the handle 110 (i.e., measured along the front and rear surfaces 113, 114 of the handle 110). In the exemplified embodiment, the outer diameter OD1 of the flexible support element 150 is greater than the first maximum thickness T1 and the second maximum thickness T2.

In the exemplified embodiment, the fifth distance D5 is greater than the first distance D1, and the first distance D1 is greater than the second distance D2. Thus, the outer periphery 155 of the distal end 152 of the flexible support element 150 is located further from the longitudinal axis A-A of the handle 110 than the point P1, and the point P1 is located further from the longitudinal axis A-A of the handle 110 than the point P2. Furthermore, the distance D4 from the distal end 152 of the flexible support element 150 to point P2 is greater than the distance D3 from the distal end 152 of the flexible support element 150 to point P1. As a result, if the oral care implement 100 were laying on a planar surface that is coincident with the reference plane RP1, the longitudinal axis A-A of the handle 110 would converge towards the reference plane RP1 as it extends from the distal end 111 of the handle 110 towards the proximal end 112 of the handle 110. As discussed in greater detail below with reference to FIGS. 4-6, this enables the flexible support element 150 to be raised/elevated relative to a support member when the oral care implement 100 is placed within a package or raised/elevated relative to a horizontal surface when the oral care implement 100 is resting thereon in a somewhat horizontal orientation.

In the exemplified embodiment, a ratio of a length of the oral care implement 100 to the third distance D3 between a distal end 152 of the flexible support element 150 and the first point P1 is between 4:1 and 4.5:1, and a ratio of the length of the oral care implement 100 to a fourth distance D4 between the distal end 152 of the flexible support element 150 and the second point P2 is between 1.5:1 and 2.0. When laying the oral care implement 100 in a horizontal position (with the longitudinal axis A-A lying substantially horizontally) on a support surface, the point P1 will contact the support surface first because it extends further from the longitudinal axis A-A than the point P2. Then, because a majority of the oral care implement 100 is located between the first point P1 and the distal end 132 of the head 130, the upper portion of the handle 110 and the head 130 will pivot rearward towards the support surface (due to a greater amount of the total weight of the oral care implement 100 being on that side of the point P1, which forms a pivot point. This results in the flexible support element 150 being elevated relative to the support surface.

As best illustrated in FIG. 2, the longitudinal axis A-A of the handle 110 and the reference plane RP1 converge with distance from the flexible support element 150 towards the head 130 without intersecting at any position along the length of the oral care implement 100. Thus, the intersection of the longitudinal axis A-A and the reference plane RP1 will occur at some location beyond the head 130 (beyond the distal end 132 of the head 130 in a direction away from the handle 110 and the flexible support element 150) which is not illustrated in the exemplified embodiment. As noted above, the head 130 extends along the longitudinal axis B-B which is oblique to the longitudinal axis A-A of the handle 110 such that the head 130 is angled away from the reference plane RP1 as it extends from the handle 110 towards the distal end 132 of the head 130. Furthermore, the longitudinal axis B-B of the head 130 intersects the longitudinal axis A-A of the handle 110 at a first location L1 along the length of the oral care implement 100 and the longitudinal axis B-B of the head 130 intersects the reference plane RP1 at a second location L2 along the length of the oral care implement 100. The first location L1 is closer to the head 130 than the second location L2, which is closer to the flexible support element 150. Furthermore, the first location L1 is axially between the second point P2 and the distal end 132 of the head 130. The second location L2 is axially between the first point P1 and the second point P2.

Figure 4:
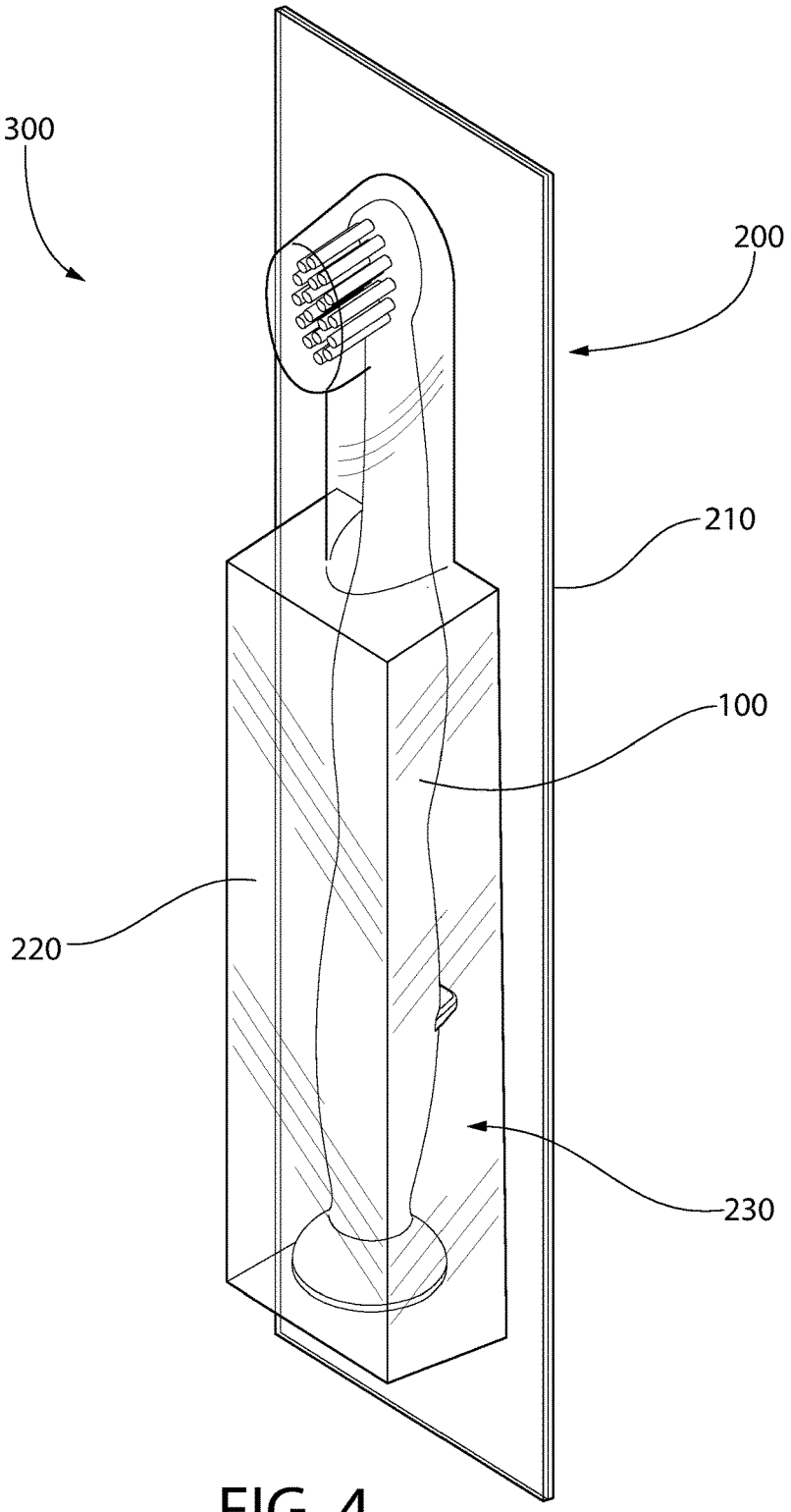
FIG. 4 is a perspective view of the oral care implement of FIG. 1 positioned within a package.

Referring now to FIG. 4, the oral care implement 100 is illustrated positioned within a package 200, thereby forming a packaged oral care implement 300. The package 200 comprises a support member 210 and a cover member 220. The package 200 in the exemplified embodiment is a blister package, although it may be modified to a clamshell package or some other type of package commonly used for holding oral care implements during sale thereof.

The support member 210 may, in one embodiment, be formed of a paper material such as cardboard, posterboard, other relatively thick paper products, plastic, film, combinations thereof, or other suitable material. The support member 210 can be a single layer or a multi-layer laminate. The support member 210 may be flexible in some embodiments, but may be rigid or semi-rigid in other embodiments.

In the exemplified embodiment, the cover member 220 is coupled to the support member 210 to define a product retaining cavity 230 therebetween. Furthermore, the cover member 220 is transparent in the exemplified embodiment to permit the oral care implement 100 to be visible therethrough. However, the cover member 220 may be translucent, colored, patterned, or the like in other embodiments. The cover member 220 is shaped so as to comprise a three-dimensional contour that may, in certain embodiments, correspond in size and shape to the oral care implement 100. The three-dimensional contour need not correspond in shape to the oral care implements 100 in all embodiments and it may just define the product retaining cavity 230 having a generic shape (i.e., rectangular or the like).

In one embodiment, the cover member 220 may be formed from a thermoformed plastic film. Suitable thermoformed plastic films may be constructed of such material as polyethyleneterephthalate (PETA, PETG, PETGAG), polyvinylchloride (PVC), polypropylene (PP) or styrol-butadiene-block copolymer (SBS), preferred PVC. Other suitable materials of construction for the thermoformed plastic film include, without limitation, renewable primary products, for example of cornstarch, sugar (polyhydroxybutyrat/-valerat), cellulose diacetate, cellulose nitrate, polyactid (PLA), and polyhydroxybutyrat (PHB).

Figure 5:
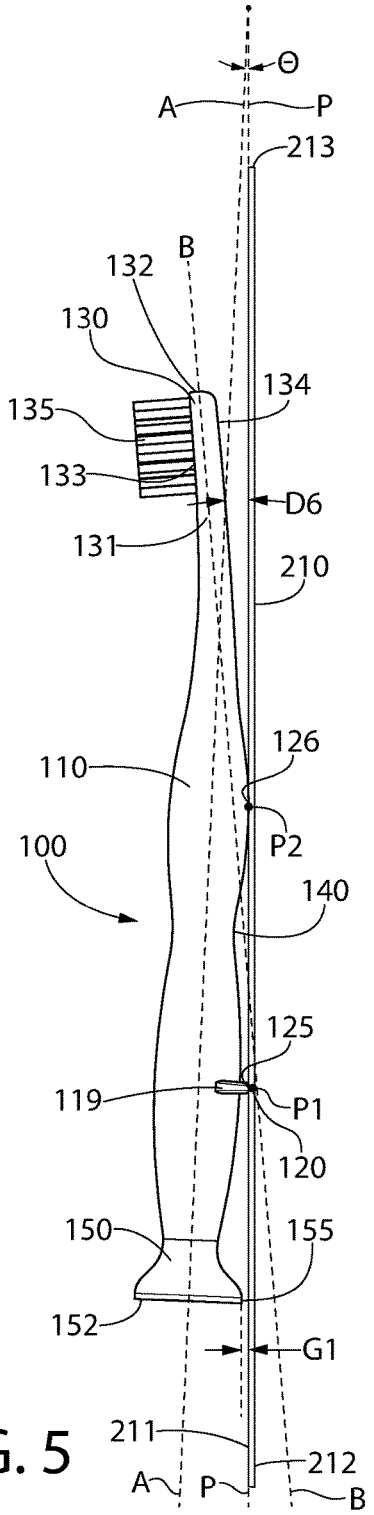
FIG. 5 is a side view of the oral care implement of FIG. 1 positioned on a support member of the package of FIG. 4.
Figure 6:
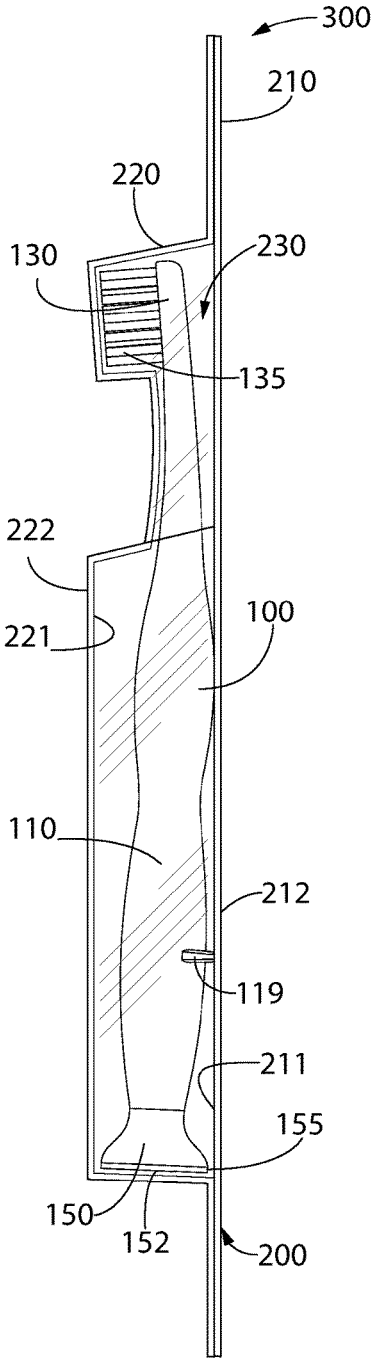
FIG. 6 is a side view of the packaged oral care implement of FIG. 4.

Referring to FIGS. 4-6 concurrently, the support member 210 has a front surface 211 and an opposite rear surface 212. In the exemplified embodiment, the support member 210 is illustrated as having a flat, planar front surface 211 and a flat, planar rear surface 212. Of course, in other embodiments one or both of the front and rear surfaces 211, 212 of the support member 210 may have various contours, three-dimensional regions or the like. The support member 210 may comprise product information, such as indicia that provide information to a consumer about the oral care implement 100 that is contained within the first package 110 of the manufacturer thereof. Such indicia may include instructions, logos, advertisements, and/or other marketing information. All or a portion of the support member 210 can be opaque so that the product information can be effectively conveyed to the consumer. The cover member 220 may also comprise such indicia either directly printed thereon or in the form of a sticker that is adhered thereto.

The cover member 220 has an inner surface 221 and an outer surface 222. The inner surface 221 of the cover member 220 and the front surface 211 of the support member 210 collectively define and bound the product retaining cavity 230. In certain embodiments, the cover member 220 may form a front cover and a rear cover of the package 110. In such an embodiment, the support member 210 may be located within the cavity formed between the front and rear covers of the cover member 220 alongside of the oral care implement 100. Thus, in such an embodiment the front and rear covers of the cover member 220 are coupled together to form a cavity for receiving the oral care implement 100, and the support member 210 is positioned within the cavity. In such embodiments, at least a portion of the support member 210 may be visible through the cover member 220 due to the transparent nature of the cover member 220.

As best seen in FIG. 5, the oral care implement 100 is positioned on the support member 210 with the rear surface 114 of the handle 110 adjacent to and at least partially in contact with the front surface 211 of the support member 210. When so positioned, a first portion 125 and a second portion 126 of the outer surface 122 of the handle 110 contact the front surface 211 of the support member 210. Specifically, the first portion 125 contacts the support member 210 at the first point P1 and the second portion 126 contacts the support member 210 at the second point P2.

Furthermore, when the oral care implement 100 is positioned on the support member 210 having the front surface 211 which is planar, the outer periphery 155 of the distal end 152 of the flexible support element 150 is spaced apart from the front surface 211 of the support member 210 by a gap G1. Thus, the oral care implement 100 can be positioned within the package 200 while maintaining the entirety of the flexible support element 150 in spaced relation relative to the front surface 211 of the support member 210 upon which the oral care implement 100 rests. This feature prevents deformation of the flexible support element 150. Specifically, when the flexible support element 150 rests in contact with the support member 210, the flexible support element 150 can be pressed against the support member 210 with some force, thereby causing deformation of the flexible support element 150. When the flexible support element 150 becomes deformed in its shape, it is unable to suction to a surface as desired. Thus, maintaining this elevated positioning of the flexible support element 150 relative to the support member 210 prevents such deformation from occurring during merchandising, sale, and storage.

As seen in FIG. 6, the cover member 220 is closely spaced relative to the tooth cleaning elements 135. Thus, if a consumer or other individual were to push downwardly on the flexible support element 130 in the direction of the support member 210 while the oral care implement 100 is contained in the package 200, the flexible support element 130 still would not be able to be pushed into contact with the front surface 211 of the support member 210 because to do so would require that the tooth cleaning elements 135 pivot away from the front surface 211 of the support member 210. However, in the exemplified embodiment there is insufficient spacing within the package 200 between the tooth cleaning elements 135 and the inner surface 211 of the cover member 220 to enable the flexible support element 150 to be forcibly pressed into contact with the front surface 211 of the support member 210.

Referring to FIGS. 5 and 6 concurrently, the front surface 211 of the support member 210 extends along a plane P-P that is oblique to the longitudinal axis A-A of the handle 110 of the oral care implement 100. Specifically, the plane P-P is identical to the reference plane RP1 described above. Thus, all of the description above with regard to the reference plane RP1 and its relationship to the longitudinal axes A-A, B-B is applicable to the plane P-P. The longitudinal axis A-A of the handle 110 and the front surface 211 of the support member 210 (and also the plane P-P) converge with distance from the flexible support element 150 in a direction towards the head 130 of the oral care implement 100. However, in the exemplified embodiment the longitudinal axis A-A of the handle 110 does not intersect the support member 210. Rather, the longitudinal axis A-A of the handle 110 and the plane P-P of the front surface 211 of the support member 210 intersect at a location that is beyond the distal end 132 of the head 130 of the oral care implement 100 and beyond a top edge 213 of the support member 210.

The longitudinal axis A-A of the handle 110 and the plane P-P of the front surface 211 of the support member 210 (and the reference plane RP1 which is coincident with the plane P-P) intersect at an angle θ of between 2° and 10°, more specifically between 2° and 7°, and still more specifically between 2° and 4°, and even more specifically between 2° and 3°. This is sufficient to ensure that the flexible support element 150 is elevated within the package to prevent deformation thereof as discussed herein.

As discussed above, the head 130 of the oral care implement 100 extends along the longitudinal axis B-B. The longitudinal axis B-B of the head 130 is oblique to the longitudinal axis A-A of the handle 110. The head 130 includes the front surface 133 from which the tooth cleaning elements 135 extend and the rear surface 134. In the exemplified embodiment, the entirety of the rear surface 134 of the head 130 is spaced apart from the front surface 211 of the support member 210. Furthermore, because the head 130 is angled away from the support member 210 with increasing distance from the handle 110, the distance (measured in a direction perpendicular to the front surface 211 of the support member 210) between the rear surface 134 of the head 130 and the front surface 211 of the support member 210 continuously increases from the proximal end 131 of the head 130 to the distal end 132 of the head 130. Thus, the distance between the rear surface 134 of the head 130 and the front surface 211 of the support member 210 is smallest at the proximal end 131 of the head 130. However, the distance D6 between the rear surface 134 of the head 130 and the front surface 211 of the support member 210 at the proximal end 131 of the head 130 is greater than the distance measured perpendicular to the front surface 211 of the support member 210 between the front surface 211 of the support member 210 and the outer periphery 155 of the flexible support element 150.

Thus, when the oral care implement 100 is positioned within the package 200, both the head 130 of the oral care implement 100 and the flexible support element 150 of the oral care implement 100 are elevated or raised relative to the front surface 211 of the support member 210. Stated another way, both the head 130 and the flexible support element 150 are spaced apart from the front surface 211 of the support member 210 while the handle 110 contacts the front surface 211 of the support member 210 at two or more locations. This protects the flexible support element 150 against deformation as discussed above so that its functionality is viable after the oral care implement 100 is removed from the package 200.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle extending along a longitudinal axis from a distal end to a proximal end and having an outer surface;

a head coupled to the proximal end of the handle;

a flexible support element coupled to the distal end of the handle;

wherein a reference plane that is non-parallel to the longitudinal axis of the handle contacts the outer surface of the handle without penetrating the outer surface of the handle or the head and without intersecting the flexible support element;

wherein the reference plane contacts the outer surface of the handle at a lowermost first point of contact closest to the flexible support element and an uppermost second point of contact closest to the head, and wherein an entire region of the outer surface of the handle located axially between the first and second points faces the reference plane without contacting the reference plane and the reference plane does not contact the handle or the head at any point between the second point and a distal end of the head; and wherein the flexible support element has a maximum outer diameter that is greater than an outer diameter of the distal end of the handle.

2. The oral care implement according to claim 1 wherein the reference plane is tangent to the handle at one or both of the first point and the second point.

3. The oral care implement according to claim 1 wherein the handle comprises a front surface, an opposite rear surface, and a protuberance extending from the rear surface of the handle and terminating at a distal end, and wherein the distal end of the protuberance comprises the first point and the second point is located directly on the rear surface of the handle.

4. The oral care implement according to claim 1 wherein the longitudinal axis of the handle and the reference plane converge with distance from the flexible support element towards the head without intersecting at any position along a length of the oral care implement.

5. The oral care implement according to claim 1 wherein the head comprises a front surface and an opposite rear surface, and further comprising a plurality of tooth cleaning elements extending from the front surface of the head, wherein the handle comprises a front surface and a rear surface that collectively form the outer surface of the handle, the reference plane contacting and facing the rear surface of the handle, and wherein the reference plane does not intersect the head or the tooth cleaning elements.

6. The oral care implement according to claim 1 wherein the handle and the flexible support element are symmetric about the longitudinal axis.

7. An oral care implement comprising:

a handle extending along a longitudinal axis from a distal end to a proximal end and having an outer surface;

a head coupled to the proximal end of the handle;

a flexible support element coupled to the distal end of the handle;

wherein a reference plane that is non-parallel to the longitudinal axis of the handle contacts the outer surface of the handle without penetrating the outer surface of the handle and without intersecting the flexible support element;

wherein the reference plane contacts the outer surface of the handle at a lowermost first point of contact closest to the flexible support element and an uppermost second point of contact closest to the head, and wherein an entire region of the outer surface of the handle located axially between the first and second points faces the reference plane without contacting the reference plane;

wherein the first point is spaced a first distance from the longitudinal axis of the handle and the second point is spaced a second distance from the longitudinal axis of the handle, each of the first and second distances being measured in a direction transverse to the longitudinal axis of the handle, wherein the first distance is greater than the second distance, and wherein the reference plane does not contact the handle or the head at any point between the second point and a distal end of the head; and wherein a ratio of a length of the oral care implement to a third distance between a distal end of the flexible support element and the first point is between 4:1 and 5:1.

8. The oral care implement according to claim 7 wherein the second point is located a fourth distance from the distal end of the flexible support element, the third and fourth distances being measured in a direction parallel to the longitudinal axis of the handle, and wherein the fourth distance is greater than the third distance such that the first point is located axially between the flexible support element and the second point.

9. The oral care implement according to claim 7 wherein the distal end of the flexible support element has an outer periphery, the flexible support element having a maximum outer diameter at the outer periphery of the distal end, and wherein the outer periphery of the distal end of the flexible support element is spaced a fifth distance from the longitudinal axis of the handle measured in a direction transverse to the longitudinal axis of the handle, the fifth distance being greater than the first distance.

10. An oral care implement comprising:

a handle extending along a longitudinal axis from a distal end to a proximal end and having an outer surface;

a head coupled to the proximal end of the handle;

a flexible support element extending from a proximal end to a distal end, the proximal end of the flexible support element being coupled to the distal end of the handle so that an outer surface of the flexible support element is flush with the outer surface of the handle;

wherein a reference plane that is non-parallel to the longitudinal axis of the handle contacts the outer surface of the handle without penetrating the outer surface of the handle or the head and without intersecting the flexible support element; and wherein the reference plane contacts the outer surface of the handle at a lowermost first point of contact closest to the flexible support element and an uppermost second point of contact closest to the head, and wherein an entire region of the outer surface of the handle located axially between the first and second points faces the reference plane without contacting the reference plane and the reference plane does not contact the handle or the head at any point between the second point and a distal end of the head.

11. The oral care implement according to claim 10 wherein an outer diameter of the flexible support element at the distal end of the flexible support element is greater than an outer diameter of the distal end of the handle.

* * * * *